US005596398A

United States Patent [19]

Woo et al.

[11] Patent Number: 5,596,398

[45] Date of Patent: Jan. 21, 1997

[54] APPARATUS AND METHOD FOR CLEANING DEVELOPER FROM AN IMAGING SUBSTRATE

[75] Inventors: Edward J. Woo, Woodbury, Minn.; Thomas W. Reeder, Asheville, N.C.

[73] Assignee: Minnesota Mining & Manufacturing Company, St. Paul, Minn.

[21] Appl. No.: 536,685

[22] Filed: Sep. 29, 1995

[51] Int. Cl.[6] ..... G03G 21/00

[52] U.S. Cl. ..... 399/346; 430/125; 399/334; 399/350

[58] Field of Search ..... 355/307, 296, 355/297; 118/652; 430/125

[56] References Cited

U.S. PATENT DOCUMENTS

| | | | |
|---|---|---|---|
| Re. 34,437 | 11/1993 | Ariyama et al. | 355/307 |
| 3,741,643 | 6/1973 | Smith et al. | 355/256 |
| 3,815,989 | 6/1974 | Davis et al. | 355/266 |
| 3,940,282 | 2/1976 | Hwa | 355/299 X |
| 3,955,533 | 5/1976 | Smith et al. | 118/652 |
| 4,325,627 | 4/1982 | Swidler et al. | 355/256 |
| 4,395,113 | 7/1983 | Buchan et al. | 355/297 |
| 4,436,054 | 3/1984 | Ceelen et al. | 118/652 |
| 4,627,705 | 12/1986 | Landa et al. | 355/326 R |
| 4,640,605 | 2/1987 | Ariyama et al. | 355/327 |
| 4,682,881 | 7/1987 | Komatsubara et al. | 355/296 |
| 4,728,987 | 3/1988 | Diola et al. | 355/245 |
| 4,801,965 | 1/1989 | Mochizuki et al. | 355/206 |
| 4,905,047 | 2/1990 | Ariyama | 355/256 |
| 4,935,788 | 6/1990 | Fantuzzo et al. | 355/326 |
| 5,021,834 | 6/1991 | Tsuruoka et al. | 355/256 |
| 5,122,839 | 6/1992 | Siegel et al. | 430/125 X |
| 5,155,534 | 10/1992 | Kurotori et al. | 355/256 |
| 5,220,384 | 6/1993 | Landa et al. | 355/256 |
| 5,221,944 | 6/1993 | Yoda et al. | 355/256 |
| 5,262,259 | 11/1993 | Chou et al. | 430/47 |
| 5,289,238 | 2/1994 | Lior et al. | 355/256 |
| 5,300,990 | 4/1994 | Thompson | 355/256 |
| 5,374,980 | 12/1994 | Kubo et al. | 355/256 |
| 5,432,591 | 7/1995 | Geleynse | 355/256 |

FOREIGN PATENT DOCUMENTS

| | | | |
|---|---|---|---|
| 0657786A1 | 6/1995 | European Pat. Off. | G03G 15/10 |
| 52-69336 | 9/1977 | Japan | 355/307 |
| 1579405 | 11/1980 | United Kingdom | G03G 15/10 |

*Primary Examiner*—Arthur T. Grimley
*Assistant Examiner*—Sophia S. Chen
*Attorney, Agent, or Firm*—Carolyn A. Bates; Steven J. Shumaker

[57] ABSTRACT

An apparatus and method for cleaning developer from an imaging substrate carry out a plurality of cleaning operations. The apparatus and method first operate to move the imaging substrate in a first direction while delivering cleaning liquid to the imaging substrate. In a subsequent operation, the apparatus and method operate to contact the imaging substrate with a cleaning blade that cleans at least some of the developer from the imaging substrate. At the same time, some of the developer cleaned from the imaging substrate collect on the cleaning blade. In another operation, the apparatus and method operate to move the imaging substrate in a second direction. During this operation, the imaging substrate removes developer collected on the cleaning blade, and the cleaning liquid cleans from the imaging substrate the developer removed from the cleaning blade. The apparatus and method next operate to discontinue contact of the cleaning blade with the imaging substrate, and discontinue delivery of the cleaning liquid to the imaging substrate. Discontinued contact and delivery of cleaning liquid can cause some of the cleaning liquid to collect on the imaging substrate. A cleaning surface therefore is applied to clean away at least some of the cleaning liquid collected on the imaging substrate.

22 Claims, 4 Drawing Sheets

APPARATUS AND METHOD FOR CLEANING DEVELOPER FROM AN IMAGING SUBSTRATE

FIELD OF THE INVENTION

The present invention relates generally to liquid electrographic imaging technology and, more particularly, to techniques for cleaning developer from an imaging substrate used in a liquid electrographic imaging system.

DISCUSSION OF RELATED ART

In a liquid electrographic imaging system, a charged imaging substrate is selectively discharged to form a latent electrostatic image representative of an original image to be reproduced. For example, a dielectric imaging substrate can be selectively discharged with an electrostatic stylus to form the latent electrostatic image. In a liquid electrophotographic imaging system, a photoreceptor is selectively discharged with radiation to form the latent electrostatic image. Developer liquid is applied to the imaging substrate, in a pattern determined by the latent image, and compressed with a squeegee roller to form a developer film. The developer liquid may comprise developer particles dispersed in a carrier liquid. The developer film creates an intermediate representation of the original image, as defined by the latent image. The developer film is transferred from the imaging substrate to an output substrate, such as a sheet of paper or film, to form a visible representation of the original image. In a multi-color, liquid electrographic imaging system, latent images are formed for each of a plurality of separated colors. Developer liquids having colors corresponding to the separated colors are applied to the imaging substrate to develop each of the latent images. The resulting developer film then is transferred to the output substrate, to form an overall color representation of the original image.

After an image or series of images has been reproduced, it may be necessary to clean away developer particles remaining on the imaging substrate in preparation for a subsequent imaging operation. A cleaning cycle also may be necessitated by a catastrophic failure such as a paper jam or a power outage. The film formed developer particles can be difficult to remove from the surface of the imaging substrate, particularly after the developer liquid has dried. Existing techniques for cleaning developer liquid from an imaging substrate such as a photoreceptor generally involve the application of a foam roller or a cleaning blade to the surface of the photoreceptor.

Unfortunately, the existing techniques for cleaning a photoreceptor with a foam roller have a number of disadvantages. For example, the developer particles can be very easily embedded in a porous foam roller. Once the developer particles are embedded in the foam roller, they are very difficult to remove. As a result, the foam roller can become contaminated with developer particles and, in a multi-color system, with several differently colored developer particles. The accumulation of developer particles can undermine the cleaning efficiency of the foam roller. Moreover, the contaminated foam roller can transfer a thin layer of developer particles to the surface of the photoreceptor during a subsequent cleaning cycle. The amount of developer transferred to the photoreceptor by the foam roller can rise to the point that the cleaning cycle actually contaminates the photoreceptor. The contamination of the photoreceptor can produce background images during subsequent imaging cycles.

The use of a cleaning blade to clean the photoreceptor also suffers from a number of problems. First, developer particles removed from the photoreceptor tend to accumulate on the blade. The accumulation of developer particles on the cleaning blade affects the cleaning efficiency of the blade in subsequent cleaning cycles. Second, when the cleaning blade is disengaged from contact with the photoreceptor upon completion of a cleaning cycle, the blade can leave behind a portion of the accumulated developer particles on the surface of the photoreceptor. Third, the cleaning blade can scratch the surface of the photoreceptor, causing permanent damage to the release coating of the photoreceptor.

SUMMARY OF THE INVENTION

In view of the disadvantages associated with existing techniques for cleaning developer from an imaging substrate such as a photoreceptor, the present invention is directed to an apparatus and method for cleaning developer from an imaging substrate in a liquid electrographic imaging system.

In a first embodiment, the present invention provides a method for cleaning developer particles from an imaging substrate, the method comprising the steps of moving the imaging substrate in a first direction, delivering a cleaning liquid to the imaging substrate, contacting the imaging substrate with a cleaning blade, the cleaning blade cleaning at least some of the developer particles from the imaging substrate, wherein at least some of the developer particles cleaned from the imaging substrate collect on the cleaning blade, and moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade.

In a second embodiment, the present invention provides an apparatus for cleaning developer particles from an imaging substrate, the apparatus comprising means for moving the imaging substrate in a first direction, means for delivering a cleaning liquid to the imaging substrate, a cleaning blade, means for contacting the imaging substrate with the cleaning blade, the cleaning blade cleaning at least some of the developer particles from the imaging substrate, wherein at least some of the developer particles cleaned from the imaging substrate collect on the cleaning blade, and means for moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade.

In a third embodiment, the present invention provides a method for cleaning developer particles from an imaging substrate, the method comprising the steps of moving the imaging substrate in a first direction, delivering a cleaning liquid to the imaging substrate, contacting the imaging substrate with a cleaning blade, the cleaning blade cleaning at least some of the developer particles from the imaging substrate, wherein at least some of the developer particles cleaned from the imaging substrate collect on the cleaning blade, moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade, discontinuing contact of the cleaning blade with the imaging substrate, continuing movement of the imaging substrate in the second direction, wherein the cleaning liquid cleans from the imaging substrate at least some of the developer particles removed from the cleaning blade upon the discontinuance of contact of the cleaning blade with the imaging substrate, discontinuing delivery of the cleaning liquid to the imaging substrate, the discontinuance of delivery of the cleaning liquid leaving an excess volume of the developer particles and the cleaning liquid on the imaging substrate, and contacting the imaging substrate with a cleaning surface while the imaging substrate is moved in the second direction, the cleaning surface substantially cleaning from the imaging substrate the excess volume of the developer particles and the cleaning liquid.

In a fourth embodiment, the present invention provides an apparatus for cleaning developer particles from an imaging substrate, the apparatus comprising means for moving the imaging substrate in a first direction, means for delivering a cleaning liquid to the imaging substrate, a cleaning blade, means for contacting the imaging substrate with the cleaning blade, the cleaning blade cleaning at least some of the developer particles from the imaging substrate, wherein at least some of the developer particles cleaned from the imaging substrate collect on the cleaning blade, means for moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade, means for discontinuing contact of the cleaning blade with the imaging substrate, means for continuing movement of the imaging substrate in the second direction, wherein the cleaning liquid cleans from the imaging substrate at least some of the developer particles removed from the cleaning blade upon the discontinuance of contact of the cleaning blade with the imaging substrate, means for discontinuing delivery of the cleaning liquid to the imaging substrate, the discontinuance of delivery of the cleaning liquid leaving an excess volume of the developer particles and the cleaning liquid on the imaging substrate, a cleaning surface, means for contacting the imaging substrate with the cleaning surface while the imaging substrate is moved in the second direction, the cleaning surface substantially cleaning from the imaging substrate the excess volume of the developer particles and the cleaning liquid.

The advantages of the apparatus and method of the present invention will be set forth in part in the description that follows, and in part will be apparent from the description, or may be learned by practice of the present invention. The advantages of the apparatus and method of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
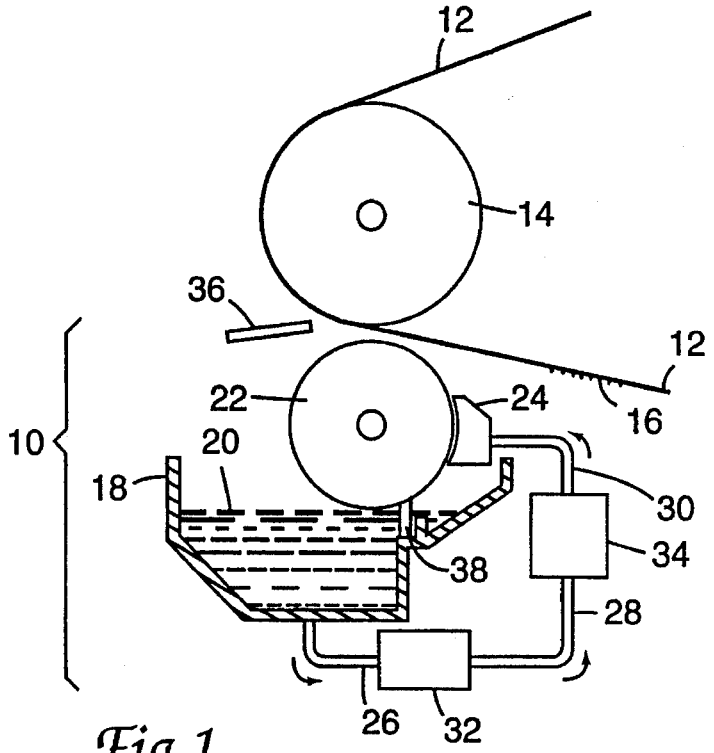
FIG. 1 is a schematic diagram of an exemplary embodiment of an apparatus for cleaning developer particles from an imaging substrate, in accordance with the present invention.

FIG. 1 is a schematic diagram of an exemplary embodiment of an apparatus 10 for cleaning developer particles from an imaging substrate in a liquid electrographic imaging system, in accordance with the present invention. In the example of FIG. 1, apparatus 10 is applied to a photoreceptor 12 in a liquid electrophotographic imaging system. In the example of FIG. 1, photoreceptor 12 is shown as comprising a photoreceptor belt mounted about a roller 14. The photoreceptor belt also is mounted about one or more additional rollers (not shown). The apparatus and method of the present invention can be readily applied, however, to a liquid electrophotographic imaging system that incorporates a photoreceptor drum, belt, or sheet, or to a liquid electrographic imaging system that incorporates a dielectric drum, belt, or sheet.

A liquid electrophotographic imaging system using photoreceptor 12 as the imaging substrate will be described for purposes of example. The liquid electrophotographic system can be configured to form a multi-color image in a single pass or in multiple passes of photoreceptor 12. Alternatively, the liquid electrophotographic imaging system may comprise a single-pass, single-color system. A multi-color, single-pass system 10 enables multi-color images to be assembled at extremely high speeds. An example of a liquid electrophotographic imaging system configured to assemble a multi-color image in a single pass of a photoreceptor is disclosed in copending and commonly assigned United States patent application Ser. No. 08/537,296, filed Sep. 29, 1995, to Truman F. Kellie et al., entitled "METHOD AND APPARATUS FOR PRODUCING A MULTI-COLORED IMAGE IN AN ELECTROGRAPHIC SYSTEM". The entire content of the above-referenced patent application is incorporated herein by reference.

The photoreceptor 12 carries an accumulation of developer particles 16. The accumulation of developer particles 16 on photoreceptor 12 can be the result of previous imaging operations in which developer liquid was applied to photoreceptor 12 to form a representation of an image, but was not completely transferred to an imaging substrate. The accumulation of developer particles 16 also could result from a catastrophic failure such as a paper jam or power outage. The developer liquid may comprise a single-colored developer liquid or, in the case of a multicolor liquid electrographic imaging system, may comprise developer liquid of several different colors.

In this description, the term "developer liquid" generally refers to the liquid applied to an imaging substrate such as photoreceptor 12 to develop a latent image. The "developer liquid" may comprise both developer particles and a carrier liquid in which the developer particles are dispersed. A suitable carrier liquid may comprise, for example, hydrocarbon solvents such as NORPAR or ISOPAR solvents commercially available from Exxon. Examples of suitable developer liquids are disclosed in copending and commonly assigned United States patent application Ser. No. 08/536,856, filed Sep. 29, 1995, entitled "LIQUID INK USING A GEL ORGANOSOL." The entire content of the above-referenced patent application is incorporated herein by reference.

In the exemplary embodiment of FIG. 1, apparatus 10 includes a reservoir 18 containing a volume of cleaning liquid 20, and a roller 22 in fluid communication with the reservoir. The cleaning liquid 20 may comprise a solvent such as, for example, NORPAR or ISOPAR hydrocarbon solvent, commercially available from Exxon, as described above. In a single-color system, the developer liquid, including the developer particles and the carrier liquid, can be used as cleaning liquid 20. In this case, the developer liquid forming the cleaner liquid and the developer liquid removed from photoreceptor 12 can be recovered for redispersion into the ink supply of the imaging system. During rotation, roller 22 passes a plenum 24, which transfers cleaning liquid 20 to a surface of the roller. The plenum 24 is coupled to reservoir 18 via pipe sections 26, 28, 30. Thus, roller 22 is in fluid communication with reservoir 18. A pump 32 transmits cleaning liquid 20 from reservoir 18 to plenum 24 via pipe sections 26, 28, 30. A filter 34 enables cleaning liquid 20 to be recycled through apparatus 10 after being used to clean photoreceptor 12. The apparatus 10 also includes a cleaning blade 36 for cleaning the surface of photoreceptor 12, and a skive blade 38 mounted within reservoir 18 for cleaning the surface of roller 22.

Figure 2:
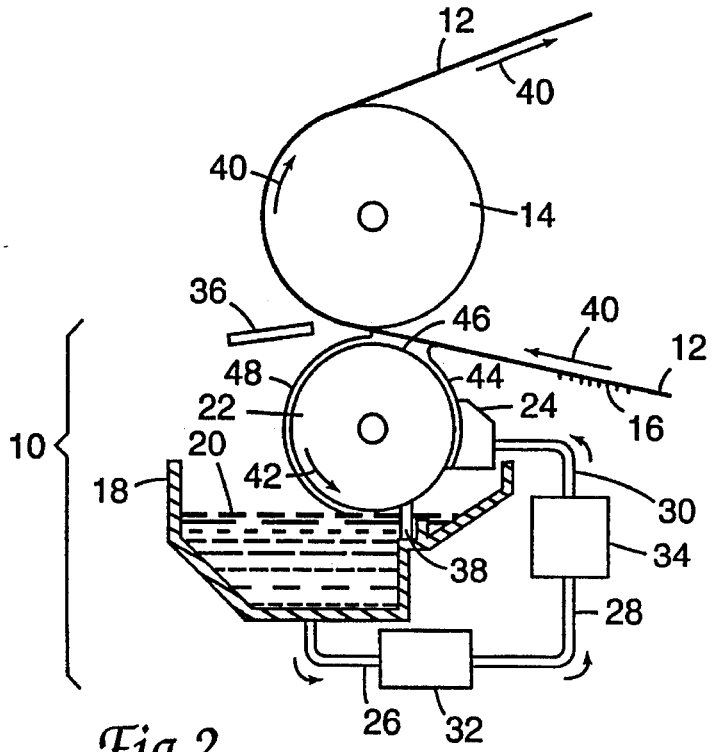
FIG. 2 is a schematic diagram of a first operation carried out by an exemplary embodiment of an apparatus and method for cleaning developer particles from an imaging substrate, in accordance with the present invention.

FIG. 2 is a schematic diagram of a first operation carried out by the apparatus 10 and method of the present invention. As shown in FIG. 2, apparatus 10 and the method of the present invention operate to clean developer particles 16 from photoreceptor 12 by first moving the photoreceptor in a first direction, indicated by arrow 40. The photoreceptor 12 can be moved by, for example, activating a motor coupled to a rotor shaft associated with one of the rollers about which the photoreceptor is mounted. During movement of photoreceptor 12 in first direction 40, cleaning liquid 20 is delivered to the surface of the photoreceptor. The cleaning liquid 20 serves to swell dried developer particles film and loosen the adhesion of the developer particles film collected on the surface of photoreceptor 12. The cleaning liquid 20 also provides lubrication for later application of cleaning blade 36, as will be explained.

The cleaning liquid 20 can be delivered to photoreceptor 12 by a variety of delivery means. For example, cleaning liquid 20 could be delivered directly to photoreceptor 12 by a manifold or by a delivery belt. In the example of FIG. 1, however, the cleaning liquid delivery means comprises cleaning liquid reservoir 18, pipe sections 26, 28, 30, pump 32, plenum 24, and roller 22. As shown in FIG. 2, roller 22 is positioned proximal to photoreceptor 12, and is moved in a direction, indicated by arrow 42, parallel to first direction 40. The roller 22 can be moved by, for example, activating a motor coupled to a rotor shaft associated with the roller. During rotation, an outer surface of roller 22 moves past plenum 24 and collects a layer 44 of cleaning liquid 20. The roller 22 continues to rotate, delivering cleaning liquid layer 44 to the surface of photoreceptor 12 via a nip 46. The roller 22 can be positioned close enough to contact the surface of photoreceptor 12. The roller 22 preferably is slightly gapped from photoreceptor 12 during this operation, however, to enable cleaning liquid 20 to flow into nip 46 in amounts sufficient to flush developer particles from cleaning blade 36, as will be described. The skive blade 38 cleans away excess cleaning liquid 48 upon each revolution of roller 22.

The cleaning liquid 20 preferably soaks the entire imaging area of photoreceptor 12. The soaking tends to more effectively loosen the dried developer particles, allowing easier removal in subsequent operations carried out by the apparatus 10 and method of the present invention. As cleaning liquid 20 is delivered, photoreceptor 12 continues to move in first direction 40, enabling delivery of the cleaning liquid to soak the entire imaging area of the photoreceptor. A soaking time of approximately six to twelve seconds has been observed as sufficient to soften and loosen the dried developer particles to a degree acceptable for subsequent removal. A longer or shorter soaking time also may give acceptable results depending on the characteristics of the particular imaging system in which the apparatus and method are applied.

Figure 3:
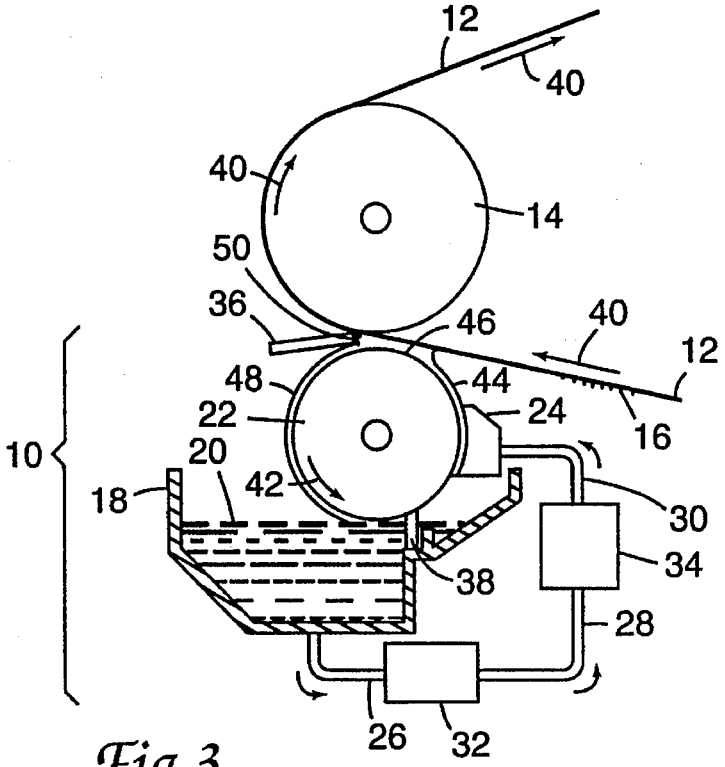
FIG. 3 is a schematic diagram of a second operation carried out by an exemplary embodiment of an apparatus and method for cleaning developer particles from an imaging substrate, in accordance with the present invention.

FIG. 3 is a schematic diagram of a second operation carried out by the apparatus 10 and method of the present invention. As shown in FIG. 3, the apparatus 10 and method of the present invention next operate to contact photoreceptor 12 with an edge of cleaning blade 36. The cleaning blade 36 may be configured, for example, for electromechanical actuation to engage and disengage the blade in contact with photoreceptor 12. The edge of cleaning blade 36 extends across a width of photoreceptor 12 in a direction perpendicular to first direction 40. The cleaning blade 36 cleans at least some of developer particles 16 from photoreceptor 12 as the photoreceptor continues to move in first direction 40. At the same time, roller 22 continues to deliver cleaning liquid 20 from reservoir 18 to the surface of photoreceptor 12.

The cleaning blade 36 should be stiff enough to remove the developer particles 12 loosened by cleaning liquid 20, but soft enough to avoid damaging the silicone release layer of photoreceptor 12. The cleaning liquid 20 assists in avoiding damage to the silicone release layer by lubricating photoreceptor 12. An example of a suitable cleaning blade 36 is a square edge urethane rubber blade having a durometer of approximately seventy to ninety Shore A. The cleaning blade 36 preferably is oriented such that the square edge contacts the surface of photoreceptor 12 at an acute angle, on the order of approximately twenty to twenty-five degrees, for example, thereby scraping dried developer particles away from the photoreceptor. The cleaning blade 36 is applied to photoreceptor 12 at a position at which the photoreceptor is supported by drive roller 14. The drive roller 14 thereby backs up photoreceptor 12 in response to the force applied by cleaning blade 36. A total force along the length of blade 36 of approximately three to four pounds (1.4 to 1.8 kilograms) has been observed to provide effective scraping action. A lesser or greater force may provide acceptable results. However, excessive force may cause damage to the release layer of photoreceptor 12.

The cleaning blade 36 can be contacted with photoreceptor 12 for one revolution of the photoreceptor in first direction 40. As cleaning blade 36 contacts photoreceptor 12, roller 22 continues to deliver cleaning liquid 20 to nip 46. The cleaning blade 36 is contacted with photoreceptor 12 at a position very close to nip 46 to enable cleaning liquid 20 to flush developer particles 16 from both the cleaning blade and the photoreceptor. If cleaning blade 36 is extended too far into nip 46 such that the blade contacts both photoreceptor 12 and roller 22, however, the blade can undesirably force cleaning liquid 20 out of the ends of the roller.

As cleaning blade 36 scrapes away developer particles 16 from photoreceptor 12, some of the developer particles tend to collect on the edge of the cleaning blade, as indicated by reference numeral 50 in FIG. 3. The edge of cleaning blade 36 is, of course, in contact with photoreceptor 12. Thus, simply disengaging cleaning blade 36 from contact with photoreceptor 12 could allow some of the particles 50 collected on the cleaning blade to remain on the surface of the photoreceptor. To avoid this problem, the apparatus and method of the present invention carry out a third operation.

Figure 4:
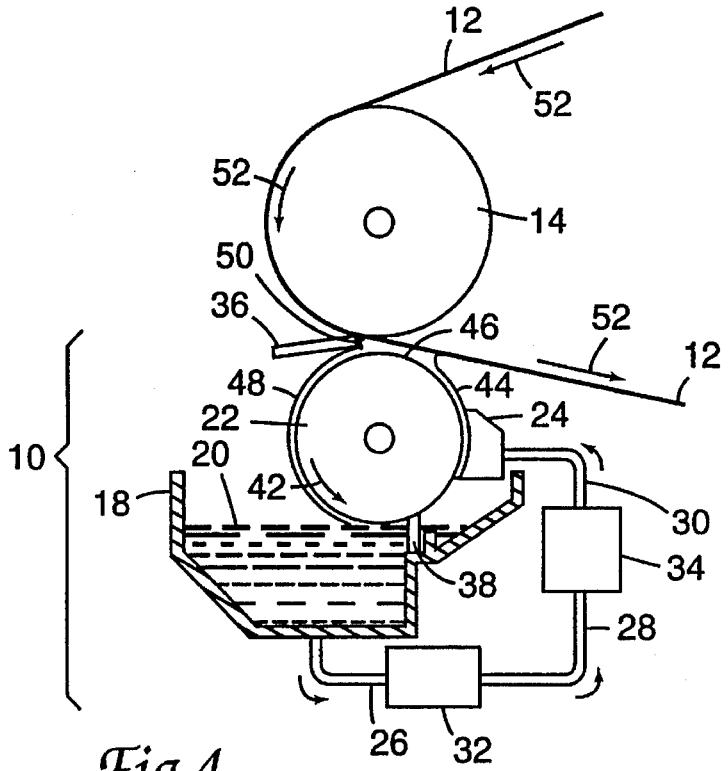
FIG. 4 is a schematic diagram of a third operation carried out by an exemplary embodiment of an apparatus and method for cleaning developer particles from an imaging substrate, in accordance with the present invention.

FIG. 4 is a schematic diagram of such a third operation. As shown in FIG. 4, the apparatus 10 and method of the present invention operate to move photoreceptor 12 to travel in a second direction, indicated by arrow 52. The second direction 52 is opposite to first direction 40. The photoreceptor 12 is moved in second direction 52 for only a short distance. For example, the distance in second direction 52 may be on the order of one inch (2.54 cm), or at least the distance between the edge of cleaning blade 36 and nip 46. By moving a short distance in second direction 52, photoreceptor 12 removes from cleaning blade 36 at least some of the developer particles 50 collected on the cleaning blade.

During movement of photoreceptor 12 in second direction 52, roller 22 continues to deliver cleaning liquid 20 from reservoir 18 to the photoreceptor via nip 46. As photoreceptor 12 moves toward nip 46, cleaning liquid 20 flushes away the developer particles 50 that the photoreceptor has previously removed from cleaning blade 36. The developer particles 50 flushed away by cleaning liquid 20 are collected from nip 46 by roller 22 and drawn downward. The developer particles carried by roller 22 then can be scraped away by skive blade 38 and allowed to fall into reservoir 18.

Figure 5:
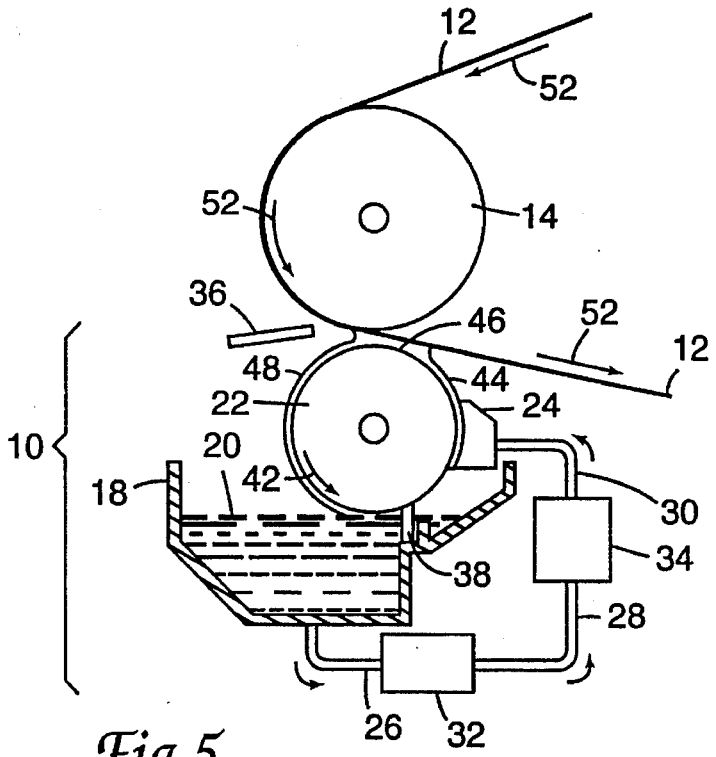
FIG. 5 is a schematic diagram of a fourth operation carried out by an exemplary embodiment of an apparatus and method for cleaning developer particles from an imaging substrate, in accordance operation.

After removing developer particles 50 from cleaning blade 36, the apparatus 10 and method of the present invention carry out a fourth operation. FIG. 5 is a schematic diagram of such a fourth operation. As shown in FIG. 5, the apparatus and method next operate to disengage cleaning blade 36 from contact with photoreceptor 12. If desired, upon disengagement, cleaning blade 36 can be placed into cleaning liquid 20 in reservoir 18 to remove any remaining developer particles. The roller 22 continues to move in first direction 42 during this fourth operation, and continues to deliver cleaning liquid 20 to photoreceptor 12 via nip 46. In addition, photoreceptor 12 continues to move in second direction 52. The cleaning liquid 20 thereby flushes away remaining developer particles that may have been trapped between cleaning blade 36 and the surface of photoreceptor 12. The photoreceptor 12 again is moved only a short distance in second direction 52, on the order of approximately one inch or the distance from the trapped developer particles to nip 46.

Figure 6:
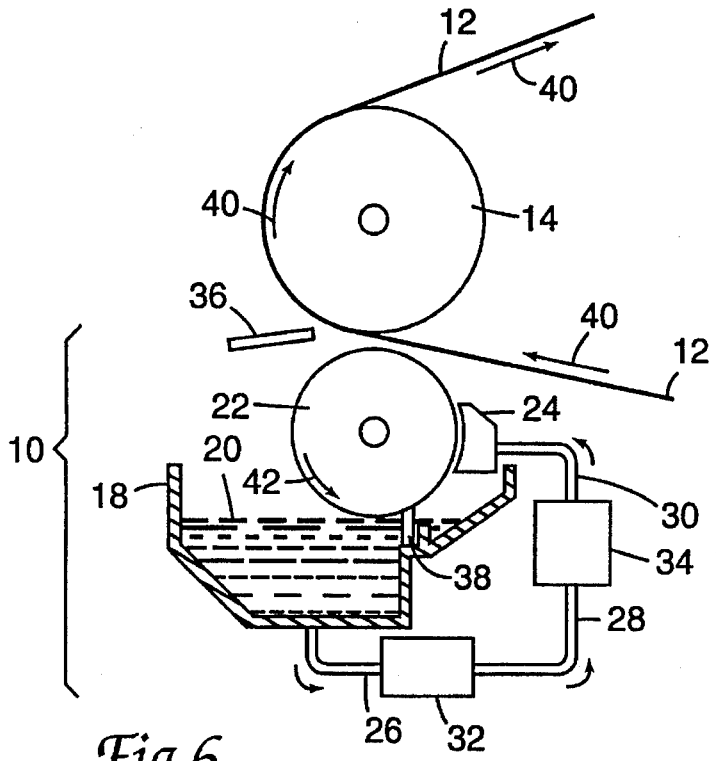
FIG. 6 is a schematic diagram of a fifth operation carried out by an exemplary embodiment of an apparatus and method for cleaning developer particles from an imaging substrate, in accordance operation.

FIG. 6 is a schematic diagram of a fifth operation carried out by the apparatus 10 and method of the present invention. As shown in FIG. 6, the apparatus 10 and method operate to disengage roller 22 from proximity with photoreceptor 12, thereby discontinuing delivery of cleaning liquid 20 via nip 46, and again move the photoreceptor in first direction 40. In addition, pump 32 is deactivated to discontinue flow of cleaning liquid 20 into nip 46. The disengagement of roller 22 leaves an excess volume of developer particles and/or cleaning liquid on photoreceptor 12. The photoreceptor 12 is moved to the position it occupied prior to the beginning of the third operation described above with respect to FIG. 4. As a result, the excess volume of developer particles and/or cleaning liquid is moved to the left of roller 22, given the orientation of FIG. 6.

Figure 7:
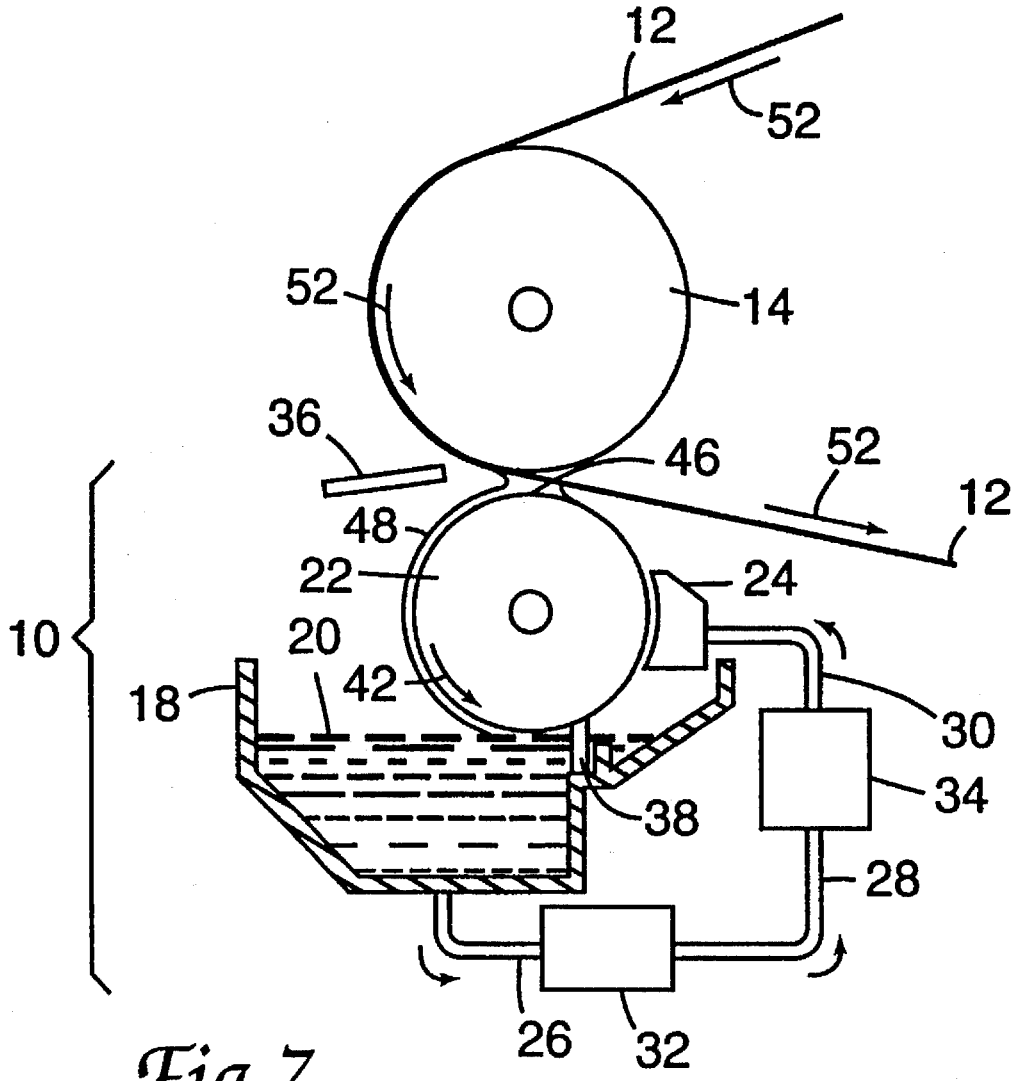
FIG. 7 is a schematic diagram of a sixth operation carried out by an exemplary embodiment of an apparatus and method for cleaning developer particles from an imaging substrate, in accordance operation.

FIG. 7 is a schematic diagram of a sixth operation carried out by the apparatus 10 and method of the present invention. As shown in FIG. 7, the apparatus 10 and method operate to again engage roller 22 in proximity with photoreceptor 12, thereby forming nip 46. At the same time, photoreceptor 12 is moved in second direction 52. The pump 32 remains deactivated, preventing flow of cleaning liquid 20 into nip 46. In the absence of cleaning liquid 20, roller 22 contacts the surface of photoreceptor 12. The roller 22 serves to remove excess developer particles 16 and/or cleaning liquid 20 remaining on the surface of photoreceptor 12. In particular, roller 22 serves to remove the excess volume previously formed by disengagement of the roller from photoreceptor 12 during the fifth operation described with respect to FIG. 5. Thus, roller 22 acts as a cleaning surface during this fifth operation. Alternative cleaning surfaces may be employed such as, for example, an additional cleaning blade or a cleaning belt. The excess cleaning liquid 20 removed by roller 22 is scraped from the roller by skive blade 38.

Ordinarily, photoreceptor 12 can be moved less than an entire revolution in second direction 52 during this sixth operation because the previous scraping operation of cleaning blade 36 removes a majority of developer particles 16 and/or cleaning liquid 20. Application of roller 22 in this sixth operation primarily is directed to removal of the developer particles and/or cleaning liquid 20 formed across a portion of photoreceptor 12 upon the previous disengagement of the roller. At the end of movement in second direction 52, photoreceptor 12 can be returned to a start position for the next imaging operation. Prior to the next imaging operation, however, it may advisable to run a drying cycle to dry any cleaning liquid 20 remaining on photoreceptor 12. For the next imaging operation, roller 22 can be disengaged from contact with photoreceptor 12. Further, the entire cleaning apparatus 10 can be constructed as an overall cleaning pod that can be disengaged from photoreceptor 12 to make room for imaging functions. The cleaning liquid 20 remaining in reservoir 18 can be pumped to a storage container between cleaning cycles, if desired, to prevent evaporation.

The following non-limiting example is provided to further illustrate the apparatus and method of the present invention.

EXAMPLE

An apparatus and method in accordance with the present invention were applied to a liquid electrophotographic imaging system having a photoreceptor belt with a length of approximately 36 inches (91.44 cm), a width of approximately 11.5 inches (29.21 cm), and a thickness of approximately 5 mils (0.0127 cm). The photoreceptor belt included a backing layer, a photoreceptor layer formed over the backing layer, a barrier layer formed over the photoreceptor layer, and a release layer formed over the barrier layer. The photoreceptor belt was mounted about three drive rollers. An imaging operation was performed whereby the photoreceptor belt was exposed with a laser to form a latent electrographic image, developer liquid was applied to the photoreceptor, and the resulting pattern of developer liquid was transferred to an imaging substrate.

After transfer of the developer liquid, an apparatus and method in accordance with the present invention were applied to the photoreceptor belt to remove developer particles remaining on the surface of the photoreceptor belt. Specifically, the photoreceptor belt was moved in a first direction at a speed of approximately 3 inches per second (7.62 cm/second). During movement of the photoreceptor belt in the first direction, a roller was engaged proximal to the photoreceptor belt to form a nip having a width of approximately 0.0625 inches (0.159 cm). The roller was made of urethane, and had a length of approximately 10.5 inches (26.7 cm), and a diameter of approximately 0.750 inches (1.91 cm). The roller passed a plenum in fluid communication with a reservoir containing NORPAR 12 solvent as a cleaning liquid. The plenum had a length of approximately 10 inches (25.4 cm) extending along the length of the roller, and a width of approximately 0.5 inches (1.27 cm) extending in the direction of movement of the roller. The roller collected from the plenum a layer of cleaning liquid having a thickness of approximately 5 mils (0.0127 cm). The cleaning liquid collected by the roller had a unit volume of approximately 3.44 milliliters per second.

The roller was moved at a speed of approximately 4 inches/second (10.16 cm/second) in the first direction to deliver the volume of cleaning liquid to the photoreceptor via the nip. The roller was allowed to deliver the volume of cleaning liquid for approximately twelve seconds, thereby soaking the entire imaging area of the photoreceptor belt. A cleaning blade was next contacted with the photoreceptor belt at a distance of approximately 0.35 inches (0.889 cm) from the center of the nip formed between the roller and the cleaning belt. The cleaning blade was a square edge urethane rubber blade having a durometer of approximately 90 durometer Shore A. The cleaning blade had a thickness of approximately 0.06 inches (0.152 cm), a width of approximately 0.5 inches (1.27 cm), and a length extending parallel to the length of the roller and across the width of the photoreceptor belt of approximately 10.5 inches (26.7 cm).

The edge of the cleaning blade contacted the surface of the photoreceptor belt at an angle of approximately twenty-five degrees. The cleaning blade was applied to the photoreceptor belt with a total force of approximately 3.5 pounds (7.7 kg) across the length of the blade. The cleaning blade was contacted with the photoreceptor for one revolution of the photoreceptor belt in the first direction. As the cleaning blade contacted the photoreceptor belt, the cleaning liquid delivered by the roller was observed to flush developer particles scraped by the cleaning blade from the nip.

The photoreceptor belt was next reversed to move in a second direction for a distance of approximately 0.2 inches (0.51 cm) at a speed of approximately 3 inches per second (7.62 cm/second). The photoreceptor belt was observed to draw developer particles away from the cleaning blade and carry the developer particles into the nip. The cleaning liquid delivered by the roller was observed to flush the developer particles carried by the photoreceptor belt from the nip. The cleaning blade was then disengaged from contact with the photoreceptor belt. The cleaning blade was observed to cause no significant damage to the release layer of the photoreceptor belt. Upon disengagement of the cleaning blade, the movement of the photoreceptor belt in the second direction was continued for a distance of approximately 1.25 inches (3.18 cm), thereby carrying developer particles left by the cleaning blade into the nip to be flushed away by the cleaning liquid. During rotation of the roller, the roller surface was continuously cleaned by the edge of a skive blade mounted to contact the roller surface.

Next, the roller was disengaged from proximity with the photoreceptor belt, thereby eliminating the nip and discontinuing the delivery of cleaning liquid. The photoreceptor belt then was reversed to move in the first direction for a distance of approximately 2.0 inches (5.08 cm) at a speed of approximately 3 inches per second (7.62 cm/second). Disengagement of the roller was observed to leave an excess volume of cleaning liquid and developer particles on the surface of the photoreceptor belt. Next, the roller was engaged in light contact with the surface of the photoreceptor belt, and the flow of cleaning liquid to the plenum was discontinued. The contact force between the roller and the photoreceptor belt was estimated to be approximately 0.20 pounds (0.1 kg) across the length of the roller. At the same time, the photoreceptor belt again was reversed to travel in the second direction for a distance of approximately 3.0 inches (7.62 cm) at a speed of approximately 3.0 inches per second (7.62 cm/second). The roller substantially removed from the photoreceptor belt the cleaning liquid and developer particles forming the excess volume. The roller was observed to cause substantially no damage to the release layer of the photoreceptor belt.

Having described the exemplary embodiments of the apparatus and method of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A method for cleaning developer particles from an imaging substrate, the method comprising the steps of:

moving the imaging substrate in a first direction;

delivering a cleaning liquid to the imaging substrate;

contacting the imaging substrate with a cleaning blade, the cleaning blade cleaning at least some of the developer particles from the imaging substrate, wherein at least some of the developer particles cleaned from the imaging substrate collect on the cleaning blade;

moving the imaging substrate in a second direction, wherein the imaging substrate removes from the cleaning blade at least some of the developer particles collected on the cleaning blade;

discontinuing contact of the cleaning blade with the imaging substrate;

continuing to move the imaging substrate in the second direction; and continuing to deliver the cleaning liquid to the imaging substrate, wherein the cleaning liquid cleans from the imaging substrate at least some of the developer particles removed from the cleaning blade.

2. The method of claim 1, wherein the step of delivering the cleaning liquid includes placing a roller proximal to the imaging substrate, and delivering the cleaning liquid via the roller from a cleaning liquid source disposed in fluid communication with the roller.

3. The method of claim 1, further comprising the steps of:

discontinuing delivery of the cleaning liquid to the imaging substrate; and contacting the imaging substrate with a cleaning surface while the imaging substrate is moved in the second direction, the cleaning surface cleaning from the imaging substrate some of the developer particles and some of the cleaning liquid remaining on the imaging substrate surface.

4. The method of claim 3, wherein the cleaning surface is a roller, the method further comprising the step of moving the roller in the first direction while the roller contacts the imaging substrate.

5. The method of claim 1, wherein the imaging substrate is a photoreceptor.

6. The method of claim 1, wherein the cleaning liquid comprises a solvent.

7. An apparatus for cleaning developer particles from an imaging substrate, the apparatus comprising:

means for moving the imaging substrate in a first direction;

means for delivering a cleaning liquid to the imaging substrate;

a cleaning blade;

means for contacting the imaging substrate with the cleaning blade, the cleaning blade cleaning at least some of the developer particles from the imaging substrate, wherein at least some of the developer particles cleaned from the imaging substrate collect on the cleaning blade;

means for moving the imaging substrate in a second direction, wherein the imaging substrate removes from the cleaning blade at least some of the developer particles collected on the cleaning blade;

means for discontinuing contact of the cleaning blade with the imaging substrate;

means for continuing movement of the imaging substrate in the second direction; and means for continuing to deliver the cleaning liquid to the imaging substrate, wherein the cleaning liquid cleans from the imaging substrate at least some of the developer particles removed from the cleaning blade.

8. The apparatus of claim 7, wherein the means for delivering the cleaning liquid includes a roller placed proximal to the imaging substrate, the roller delivering the cleaning liquid from a cleaning liquid source disposed in fluid communication with the roller.

9. The apparatus of claim 7, further comprising:

means for discontinuing delivery of the cleaning liquid to the imaging substrate; and means for contacting the imaging substrate with a cleaning surface while the imaging substrate is moved in the second direction, the cleaning surface cleaning from the imaging substrate some of the developer particles and some of the cleaning liquid remaining on the imaging substrate surface.

10. The apparatus of claim 9, wherein the cleaning surface is a roller, the apparatus further comprising means for moving the roller in the first direction while the roller contacts the imaging substrate.

11. The apparatus of claim 7, wherein the imaging substrate is a photoreceptor.

12. The apparatus of claim 7, wherein the cleaning liquid comprises a solvent.

13. A method for cleaning developer particles from an imaging substrate, the method comprising the steps of:

moving the imaging substrate in a first direction;

delivering a cleaning liquid to the imaging substrate;

contacting the imaging substrate with a cleaning blade, the cleaning blade cleaning at least some of the developer particles from the imaging substrate, wherein at least some of the developer particles cleaned from the imaging substrate collect on the cleaning blade;

moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade;

discontinuing contact of the cleaning blade with the imaging substrate;

continuing movement of the imaging substrate in the second direction, wherein the cleaning liquid cleans from the imaging substrate at least some of the developer particles removed from the cleaning blade upon the discontinuance of contact of the cleaning blade with the imaging substrate;

discontinuing delivery of the cleaning liquid to the imaging substrate, the discontinuance of delivery of the cleaning liquid leaving an excess volume of the developer particles and the cleaning liquid on the imaging substrate; and contacting the imaging substrate with a cleaning surface while the imaging substrate is moved in the second direction, the cleaning surface substantially cleaning from the imaging substrate the excess volume of the developer particles and the cleaning liquid.

14. The method of claim 13, wherein the step of delivering the cleaning liquid includes placing a roller proximal to the imaging substrate, and delivering the cleaning liquid via the roller from a cleaning liquid source disposed in fluid communication with the roller.

15. The method of claim 13, wherein the cleaning surface is a roller, the method further comprising the step of moving the roller in the first direction while the roller contacts the imaging substrate.

16. The method of claim 13, wherein the imaging substrate is a photoreceptor.

17. The method of claim 13, wherein the cleaning liquid comprises a solvent.

18. An apparatus for cleaning developer particles from an imaging substrate, the apparatus comprising:

means for moving the imaging substrate in a first direction;

means for delivering a cleaning liquid to the imaging substrate;

a cleaning blade;

means for contacting the imaging substrate with the cleaning blade, the cleaning blade cleaning at least some of the developer particles from the imaging substrate, wherein at least some of the developer particles cleaned from the imaging substrate collect on the cleaning blade;

means for moving the imaging substrate in a second direction, wherein the imaging substrate removes from the cleaning blade at least some of the developer particles collected on the cleaning blade, and wherein the cleaning liquid cleans from the imaging substrate at least some of the developer particles removed from the cleaning blade;

means for discontinuing contact of the cleaning blade with the imaging substrate;

means for continuing movement of the imaging substrate in the second direction, wherein the cleaning liquid cleans from the imaging substrate at least some of the developer particles removed from the cleaning blade upon the discontinuance of contact of the cleaning blade with the imaging substrate;

means for discontinuing delivery of the cleaning liquid to the imaging substrate, the discontinuance of delivery of the cleaning liquid leaving an excess volume of the developer particles and the cleaning liquid on the imaging substrate;

a cleaning surface;

means for contacting the imaging substrate with the cleaning surface while the imaging substrate is moved in the second direction, the cleaning surface substantially cleaning from the imaging substrate the excess volume of the developer particles and the cleaning liquid.

19. The apparatus of claim 18, wherein the means for delivering the cleaning liquid includes a roller, means for placing the roller proximal to the imaging substrate, and a cleaning liquid source disposed in fluid communication with the roller, the cleaning liquid source containing the cleaning liquid, and the roller delivering the cleaning liquid to the imaging substrate from the cleaning liquid source.

20. The apparatus of claim 18, wherein the cleaning surface is a roller, the apparatus further comprising means for moving the roller in the first direction while the roller contacts the imaging substrate.

21. The apparatus of claim 18, wherein the imaging substrate is a photoreceptor.

22. The apparatus of claim 18, wherein the cleaning liquid comprises a solvent.

* * * * *